United States Patent [19]

Millington

[11] Patent Number: 4,879,866

[45] Date of Patent: Nov. 14, 1989

[54] HEAD POLE

[76] Inventor: Howard G. Millington, 29 Perry Rd., Cable, Ohio 43009

[21] Appl. No.: 211,590

[22] Filed: Jun. 27, 1988

[51] Int. Cl.[4] ..... B68B 1/00

[52] U.S. Cl. ..... 54/71

[58] Field of Search ..... 54/1, 2, 71; 119/109, 119/127, 151, 152

[56] References Cited

U.S. PATENT DOCUMENTS 872,347 12/1907 Howell ..... 54/71
1,463,175 7/1923 Rasmussen ..... 119/152
2,854,801 10/1958 Spiezio et al. ..... 54/71
3,765,151 10/1973 Hall ..... 54/71

*Primary Examiner*—Robert P. Swiatek
*Attorney, Agent, or Firm*—Thomas S. Baker, Jr.

[57] ABSTRACT

A head pole adapted to engage a halter ring at one end and a saddle strap at the other end has a piston with an opening for receiving the halter ring and a sleeve slidable to open and close the opening having a raised shoulder formed on the outer surface of the sleeve to provide a lateral thrust surface to enable an operator to apply a longitudinally directed force to easily move the sleeve.

2 Claims, 1 Drawing Sheet

HEAD POLE

BACKGROUND OF THE INVENTION

In harness racing horses pull sulkies containing drivers around a track utilizing a specified gait. In order to prevent a horse from becoming distracted by other horses and sulkies on the track beside him in the course of a race and to improve a driver's control over his horse the horse's head must be kept straight such that the animal has minimal freedom to move his head side to side. Side to side movement of a horse's head traditionally has been limited through utilization of a mechanical device known as a head pole. Such a device utilizes a relatively rigid rod having one end connected to a leather halter on the horse's head and the other end connected to a leather saddle mounted on the horse's back. The rear end of the head pole which connects to the saddle may be attached thereto by a strap having one end rigidly affixed to the saddle which passes through a slot in the end of the head pole and engages a buckle that is rigidly attached to the saddle. In order to enable a horse to move its head in fore and aft directions when the head halter has been attached to a head pole the head pole includes at least two concentric telescoping sections.

The front end of the head pole engages a metal ring attached to one side of the halter adjacent the horse's face. Traditional head poles have a piston at the front end thereof having a slot which opens into its outer surface. A movable spring loaded sleeve slides over the outer surface of the piston and in one position overlies the slot and in the other position exposes the slot. The sleeve is spring biased towards the first position to retain a ring once it has been placed in the slot.

In order for a person to attach or detach the front end of a head pole to a halter ring the operator must apply a lateral squeezing force to the outer surface of the sleeve and slide it against the action of the spring to the second position such that the lateral slot formed in the piston becomes exposed and the halter ring may be inserted or removed therefrom. To provide a person with a means for gripping the sleeve it has been a common practice to knurl the outer surface of the sleeve. However, despite the knurled surface formed on sleeve it remains a problem for a person to move a sleeve between the first and second positions when the sleeve is wet or cold because the person's ability to apply a lateral squeezing force on the sleeve becomes adversely affected under these conditions.

SUMMARY OF THE INVENTION

A head pole adapted to engage a halter ring at one end and a saddle strap at the other end to prevent lateral movement of a horse's head comprises a rod having strap receiving means at one end adapted to receive a saddle strap and a coupling member rigidly affixed to the other end. A piston member is affixed to the coupling such that the piston extends in a direction opposite from that of the rod. An opening is formed in the piston to receive the halter ring. A sleeve having an axial bore defining an inner surface slides over the outer surface of the piston and is movable between a first position in which it overlies and covers the piston opening and a second position in which it is remote from said opening such that the opening is uncovered to receive or discharge the halter ring. A spring biases the sleeve into the first position. A raised shoulder formed on the outer surface of the sleeve projects radially outwardly from the sleeve outer surface to thereby provide a lateral thrust surface to enable an operator to push against the thrust surface in a direction parallel to the longitudinal axis of the sleeve and thereby move the sleeve from the first position to the second position.

DESCRIPTION OF THE PREFERRED EMBODIMENT

Figure 1:
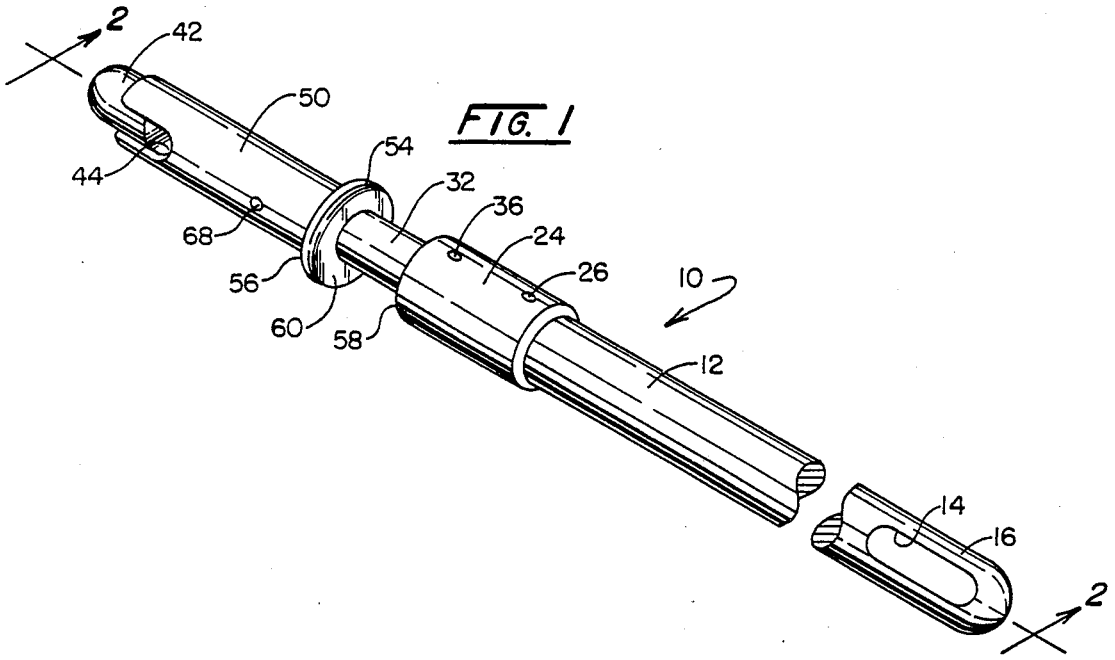
FIG. 1 is a perspective view of the head pole of the instant invention.

Turning to the drawings, it may be seen that the head pole (10) includes a rod (12) which may be constructed out of fiber glass, carbon fibers, aluminum or any suitable light weight material. Typically, rod (12) will include two concentric sections one received within a longitudinal bore of the other to thereby provide a rod which may be extended and retracted longitudinally a limited distance. The head pole (10) has one end adapted to engage a halter ring adjacent a horse's face and the other end adapted to be secured to a saddle on the horse's back. Accordingly, rod (12) has an elongated, longitudinally extending slot (14) formed in one end (16) thereof adapted to receive a saddle strap.

The opposite end (18) of rod (12) has its outer surface (20) received partially within the cylindrical inner surface (22) of a coupling (24). A laterally extending metal pin (26) passes through laterally projecting aligned bores (28) and (28') in coupling (24) and bore (30) in rod (12) to firmly capture the rod end (18) within the coupling inner surface (22).

A piston (32) projects longitudinally from coupling (24) in a direction opposite to that of rod (12). Piston (32) has a generally cylindrical outer surface with an enlarged diameter portion (34) that is received within coupling inner surface (22). A metal pin (36) passes through a pair of laterally projecting aligned bores (38) and (38') in coupling (24) and a pair of laterally projecting aligned bores (40) and (40') in piston (32) to thereby rigidly affix piston (32) to coupling (24). Piston (32) has a slightly reduced diameter cylindrical outer portion (42) that includes a lateral slot or opening (44). The opening (44) is adapted to receive a halter ring.

A cylindrical sleeve (50) having a bore defining an inner cylindrical surface (52) slides on the surface of the reduced diameter portion (42) of piston (32). Sleeve (50) includes a raised shoulder (54) having a lateral thrust surface (56) adapted to receive longitudinal thrust forces exerted by the fingers and thumb of a person to thereby move the sleeve (50) to the right towards the coupling (24). It should be observed that the overall length of sleeve (50) is somewhat less than the distance between the lateral surface (58) defining one end of coupling (24) and the lateral opening (44) in piston (32). Thus, when sleeve (50) has been moved to the right such that the head end (60) of raised shoulder (54) engages the lateral surface (58) of coupling (24) the opening (44) in piston (32) will be uncovered.

Figure 2:
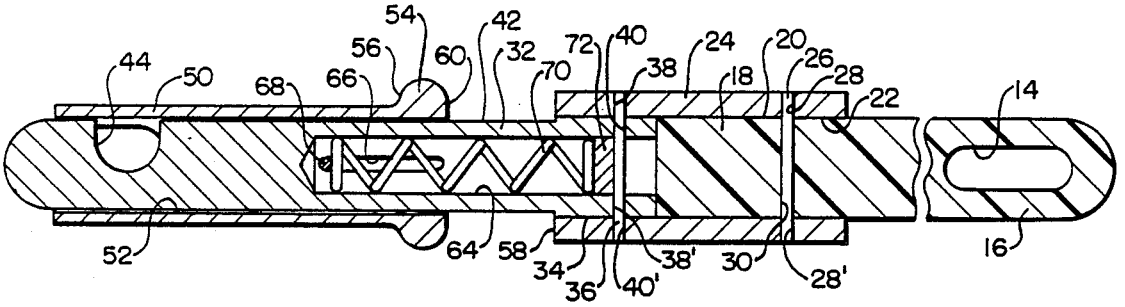
FIG. 2 is a view along line 2—2 of FIG. 1.

Turning to FIG. 2, it may be observed that sleeve (50) is spring biased to the left to a position in which it overlies or covers the opening (44) in piston (32). The piston (32) has a longitudinal inner bore (64) formed in one end thereof and a pair of elongated longitudinally extending slots (66) formed in the side walls surrounding the bore (64). A metal pin (68) projects laterally through a pair of aligned bores, not shown, in cylindrical sleeve (50) and projects through the slots (66) formed in piston (32). In this way sleeve (50) is retained on piston (32). The sleeve (50) is movable between a first position in which the pin (68) is moved to one end of the slots (66) and sleeve (50) overlies lateral opening (44) and a second position in which pin (68) is moved to the opposite ends of the slots (66) wherein head end (60) of raised shoulder (54) engages the lateral surface (58) defining one end of coupling (24) and the lateral opening (44) is uncovered. A spring (70) contained within bore (64) of piston (32) by an end plug (72) acts against the pin (68) to bias it to the left end of the slots (66) such that the sleeve overlies the lateral opening (44) in piston (32).

In order for an operator to insert a halter ring into the lateral opening (44) or to remove a halter ring from that opening a person must simply slide his thumb and fingers to the right until they engage the lateral thrust surface (56) and continue to push longitudinally to the right to apply a longitudinal thrust force to cause the sleeve (50) to move to the right until the head end (60) of shoulder (54) engages coupling (24). Lateral gripping of the sleeve (50) is unnecessary. Subsequent to a halter ring being inserted into or removed from the lateral opening (44) an operator may simply release the sleeve (50) and the spring (70) will cause the sleeve (50) to return to a position in which it overlies or covers the opening (44).

Since certain changes may be made to the above described apparatus without departing from the scope of the invention herein, it is intended that all matter contained in the description thereof or shown in the accompanying drawings shall be interpreted as illustrative and not in a limiting sense.

I claim:

1. A head pole adapted to engage a halter ring at one end and a saddle strap at the other end to prevent lateral movement of a horse's head comprising:

a rod;

a saddle strap receiving means at one end of said rod adapted to receive said strap;

a coupling member having one end receiving the other end of said rod;

a piston affixed to the other end of said coupling member wherein said piston projects away from said rod;

a slidable sleeve having an inner end adjacent said coupling member, an outer end remote from said coupling member, an outer surface and an axial bore defining an inner surface adapted to slide over the outer surface of said piston;

an opening formed in said piston adapted to receive said halter ring;

a pair of slot adjacent the outer end of said sleeve which slots overlie said piston opening;

said sleeve movable between a first position which said sleeve outer end overlies and covers said piston opening and a second position in which said sleeve outer end is remote from said opening such that said piston opening is uncovered to receive or discharge said ring;

wherein said ring is received within said slots when said ring is received with said piston opening;

spring means for biasing said sleeve into said first position, and a rounded raised shoulder formed on the outer surface at the inner end of said sleeve wherein said raised shoulder projects radially outwardly from said sleeve outer surface to thereby provide a lateral thrust surface to enable an operator to push against said thrust surface in a direction parallel to the longitudinal axis of said sleeve and thereby move said sleeve from said first position to said second position.

2. The head pole of claim 1, in which said raised shoulder is cylindrical.

* * * * *